US008567002B2

(12) United States Patent
Li

(10) Patent No.: US 8,567,002 B2
(45) Date of Patent: Oct. 29, 2013

(54) DUST COLLECTOR FOR MOBILE ROBOTIC VACUUM CLEANER

(75) Inventor: Gary Li, Guangdong (CN)

(73) Assignee: Egenpower Inc., Laguna Niguel, CA (US)

( * ) Notice: Subject to any disclaimer, the term of this patent is extended or adjusted under 35 U.S.C. 154(b) by 382 days.

(21) Appl. No.: 12/954,122

(22) Filed: Nov. 24, 2010

(65) Prior Publication Data

US 2012/0084934 A1 Apr. 12, 2012

(30) Foreign Application Priority Data

Oct. 11, 2010 (CN) ..... 2010 2 0575537 U

(51) Int. Cl.
*A47L 5/30* (2006.01)

(52) U.S. Cl.
USPC ..... 15/319; 15/339; 15/347; 15/349

(58) Field of Classification Search
USPC ..... 15/319, 339, 349, 347
IPC ..... A47L 5/30
See application file for complete search history.

(56) References Cited

U.S. PATENT DOCUMENTS

| | | | | |
|---|---|---|---|---|
| 3,906,585 | A * | 9/1975 | Mattsson | 15/349 |
| 4,137,052 | A * | 1/1979 | du Pont et al. | 48/89 |
| 5,018,240 | A * | 5/1991 | Holman | 15/349 |
| 6,883,201 | B2 | 4/2005 | Jones et al. | |
| 2006/0137133 | A1 * | 6/2006 | Yik et al. | 15/349 |
| 2009/0300873 | A1 * | 12/2009 | Grey | 15/349 |
| 2011/0277269 | A1 * | 11/2011 | Kim et al. | 15/349 |

* cited by examiner

*Primary Examiner* — David Redding
(74) *Attorney, Agent, or Firm* — Muncy, Geissler, Olds & Lowe, PLLC

(57) ABSTRACT

Used in a mobile robotic vacuum cleaner, a dust collector is disclosed to include a dust collection box, and a chips collection box connected to the dust collection box. The chips collection box comprises two openings respectively disposed adjacent to one respective roller brush of the mobile robotic vacuum cleaner and adapted for receiving chips directed by the roller brush for enabling the directed chips to be gathered in the chips collection box. Thus, dust sucked by the mobile robotic vacuum cleaner and chips directed by the roller brushes are respectively collected in the dust collection box and the chips collection box, and any non-dust articles that are accidentally directed into the chips collection box can be discovered and cleaned easily by the user.

6 Claims, 5 Drawing Sheets

DUST COLLECTOR FOR MOBILE ROBOTIC VACUUM CLEANER

BACKGROUND OF THE INVENTION

1. Field of the Invention

The present invention relates to mobile robotic vacuum cleaner technology and more specifically, to a dust collector for mobile robotic vacuum cleaner.

2. Description of the Related Art

A conventional mobile robotic vacuum cleaner is known comprising a dust collector that has an inlet for letting air in, an outlet for letting air out, and a wire gauze filter mounted in the outlet for removing dust from air passing out of the outlet and keeping filtered dust in the dust collector. Further, the autonomous floor-cleaning robot as disclosed in U.S. Pat. No. 6,883,201, includes continuously rotatable brush means for moving heavy particles from the floor into the inside of the dust collection box therein.

However, during operation of the aforesaid prior art autonomous floor-cleaning robot, non-dust articles may be brushed from the floor into the inside of the dust collection box. When the user is cleaning the dust collection box, the non-dust articles have already mixed with dust and are difficult to be cleaned. These non-dust articles may be directly discarded with the dust by the user without being viewed. Therefore, an improvement in this regard is necessary.

SUMMARY OF THE INVENTION

The present invention has been accomplished under the circumstances in view. It is the main object of the present invention to provide a dust collector for mobile robotic vacuum cleaner, which eliminates the drawbacks of the aforesaid prior art autonomous floor-cleaning robot.

To achieve this and other objects of the present invention, a dust collector used in a mobile robotic vacuum cleaner comprises a dust collection box and a chips collection box connected to the dust collection box. The chips collection box comprises at least one opening disposed adjacent to one respective roller brush of the mobile robotic vacuum cleaner and adapted for receiving chips directed by the roller brush for enabling the chips to be gathered in the chips collection box. Thus, dust sucked by the mobile robotic vacuum cleaner and chips directed by the roller brushes are respectively collected in the dust collection box and the chips collection box, and any non-dust articles that are accidentally directed into the chips collection box can be discovered and cleaned easily by the user.

Other and further advantages and features and the installation or use of the dust collector for mobile robotic vacuum cleaner of the present invention will be understood by reference to the following specification in conjunction with the accompanying drawings. It is to be understood that the appended drawings illustrate only the preferred embodiment encompassed within the scope of the present invention, and therefore, is not to be considered limiting, for the present invention may admit to other equally effective embodiments.

DETAILED DESCRIPTION OF THE INVENTION

Referring to FIGS. 1-5, a dust collector 20 in accordance with the present invention is shown used in a mobile robotic vacuum cleaner 10, comprising a dust collection box 30 and a chips collection box 40.

Figure 1:
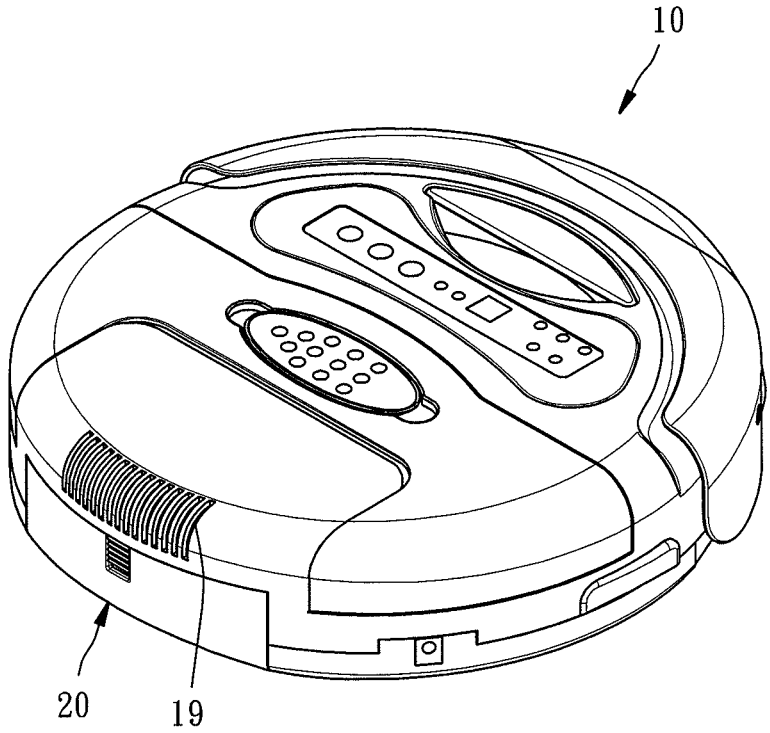
FIG. 1 is an elevational view of mobile robotic vacuum cleaner equipped with a dust collector in accordance with a first embodiment of the present invention.
Figure 2:
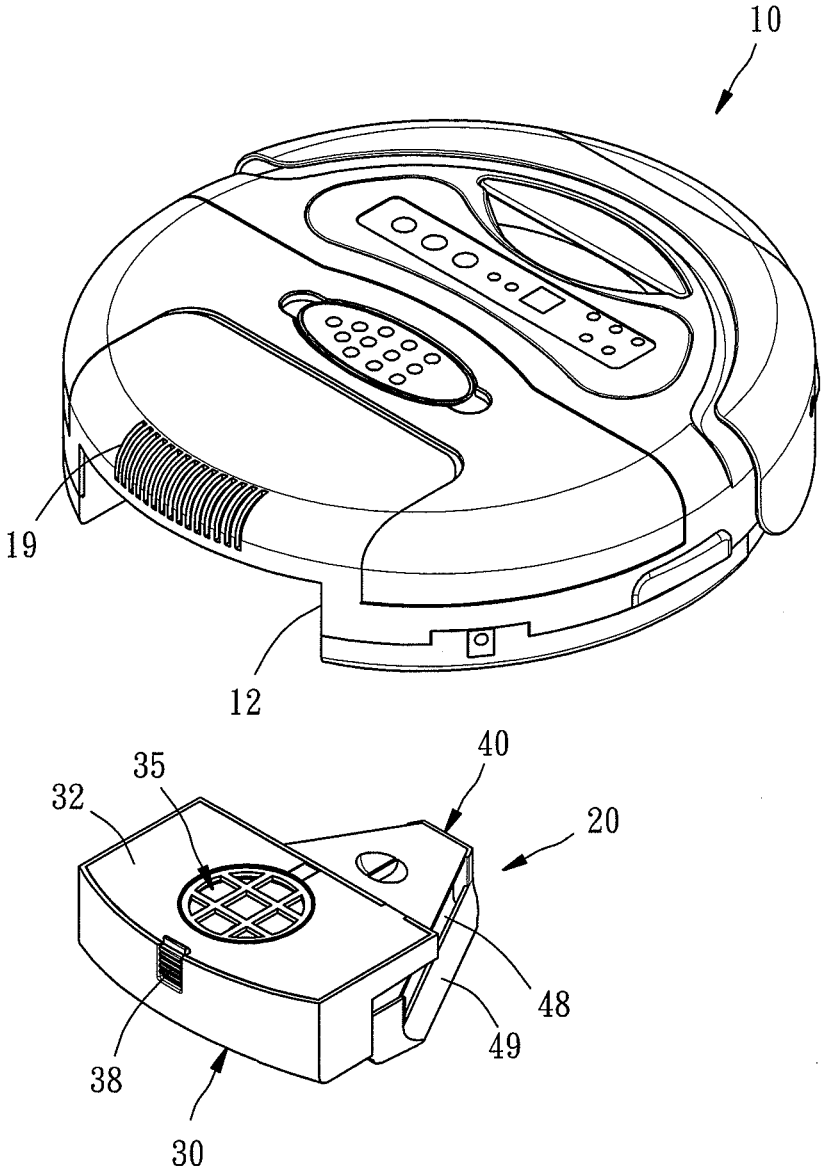
FIG. 2 is an exploded view of the mobile robotic vacuum cleaner shown in FIG. 1.
Figure 3:
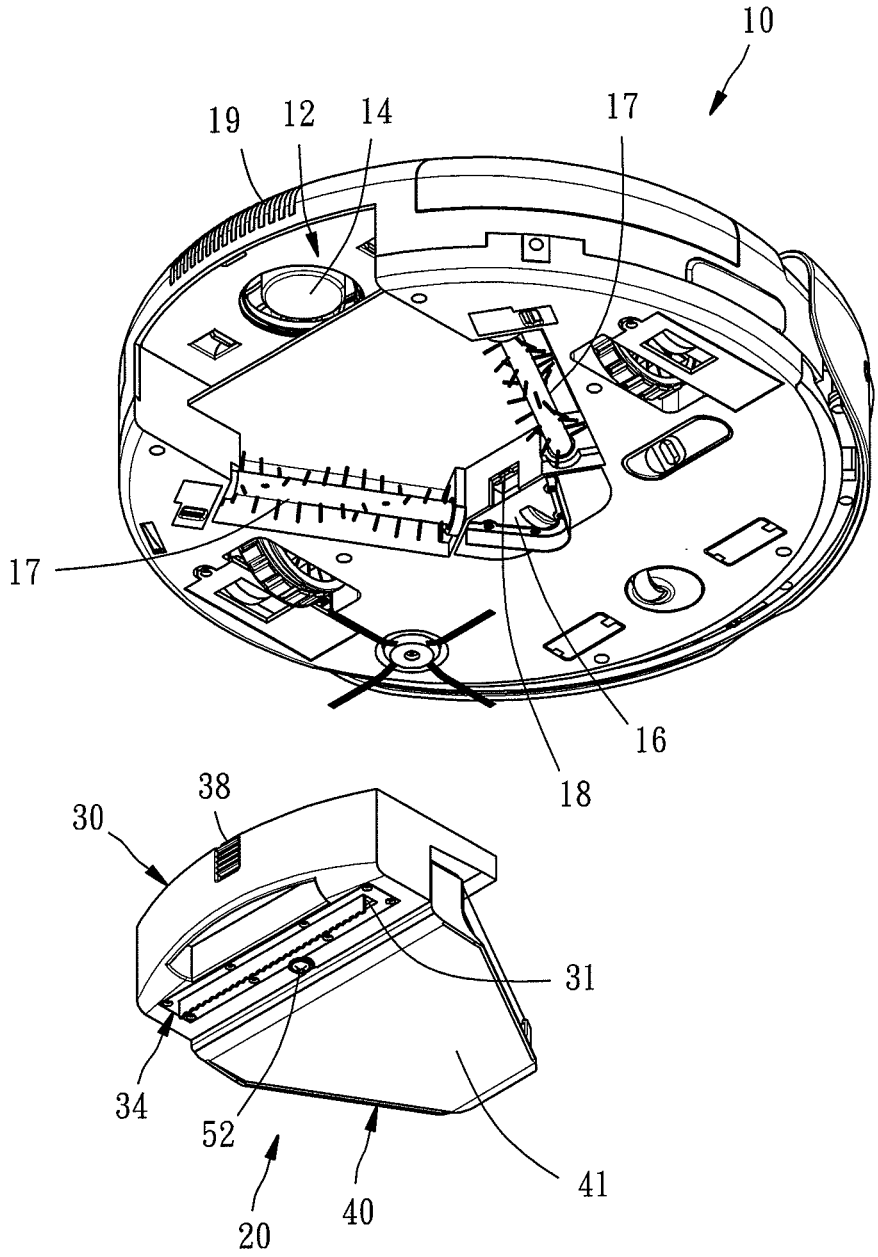
FIG. 3 corresponds to FIG. 2 when viewed from another angle.

Referring to FIG. 3, the mobile robotic vacuum cleaner 10 comprises a dust collector mounting trough 12 adapted for accommodating the dust collector 20, an electric fan 14 disposed in the top side of the dust collector mounting trough 12, a driver 16 disposed at a front side in the dust collector mounting trough 12, and two roller brushes 17 respectively mounted in left and right sides in the dust collector mounting trough 12 and rotatable by the driver 16.

Figure 4:
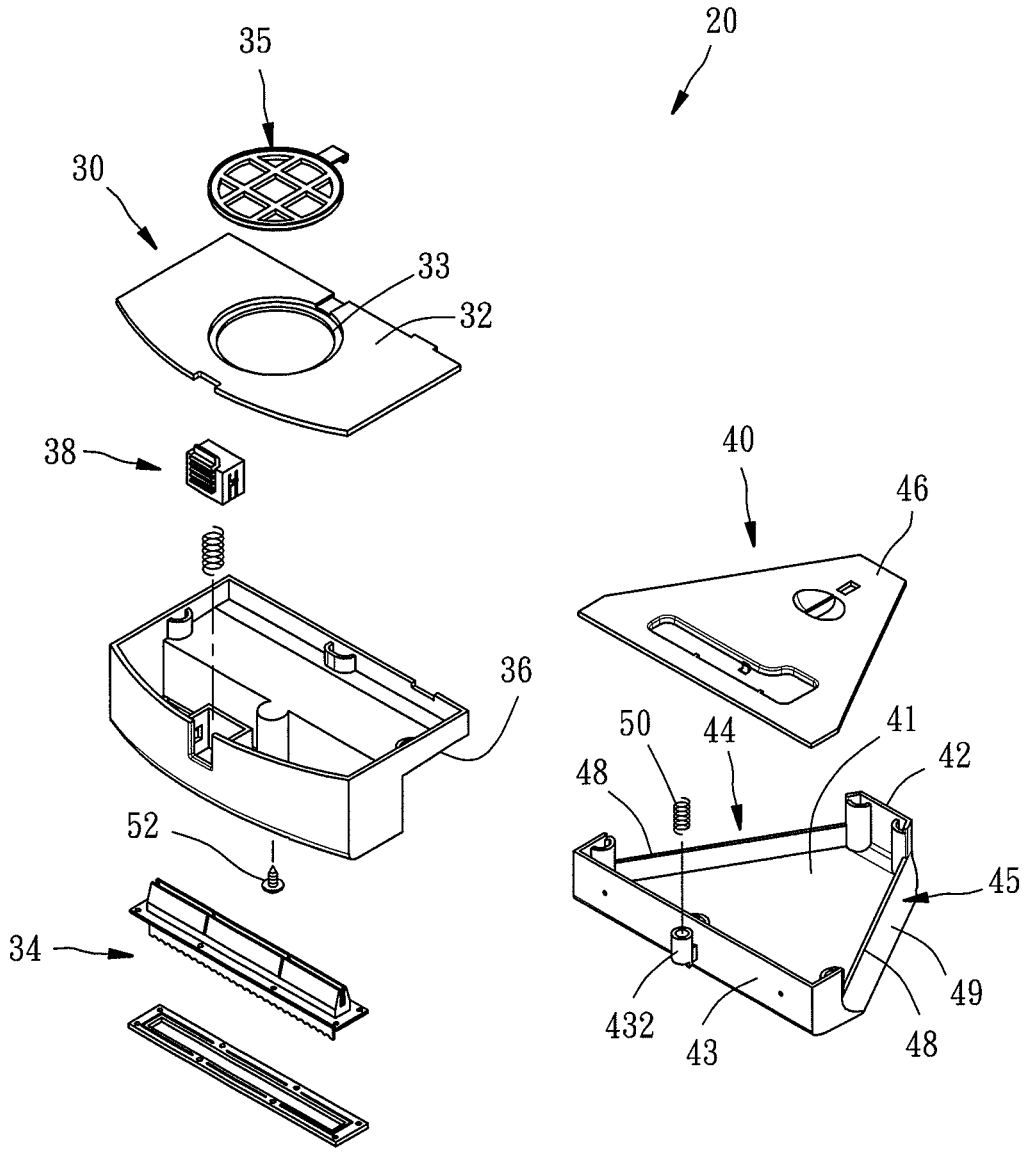
FIG. 4 is an exploded view of the dust collector in accordance with the present invention.
Figure 5:
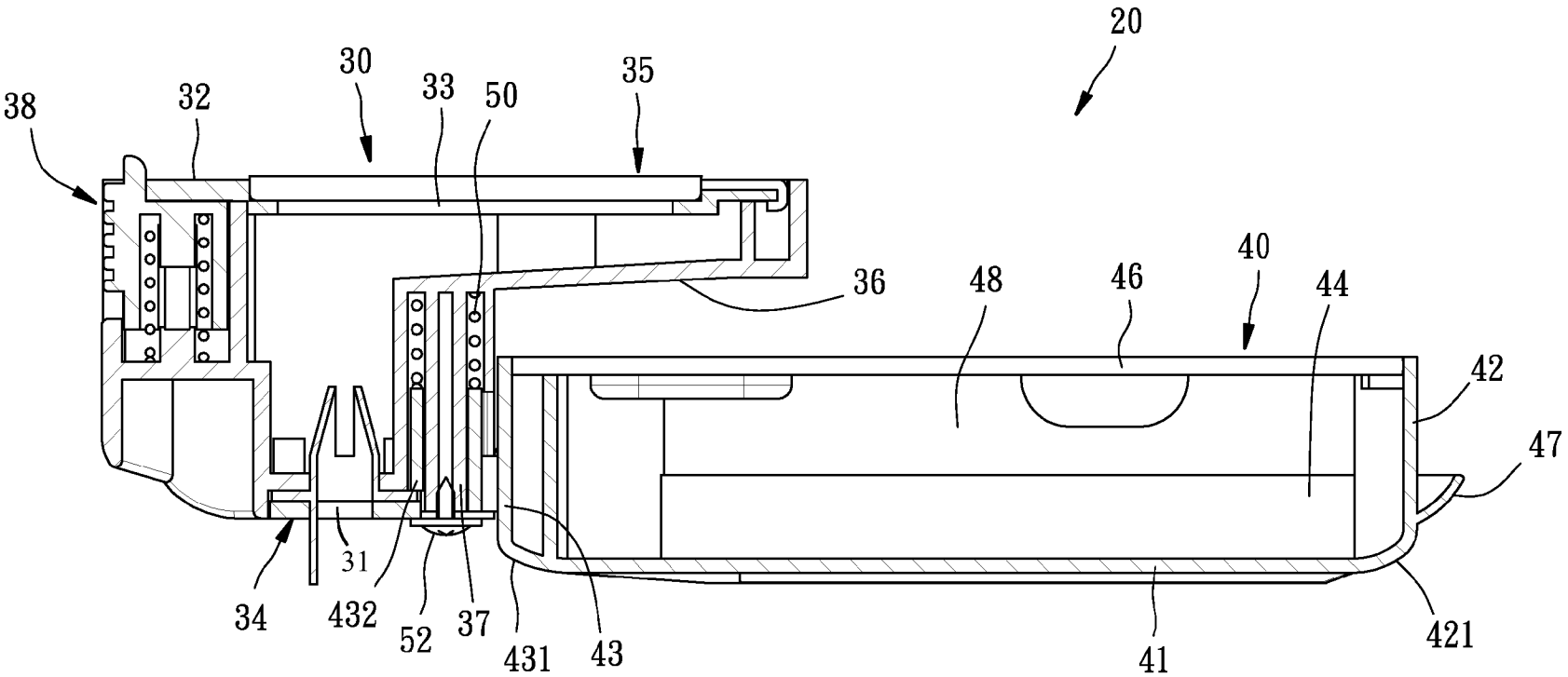
FIG. 5 is a sectional view of the dust collector in accordance with the present invention.

Referring to FIGS. 3-5, the dust collection box 30 is substantially similar to the structure of the dust collection box of a conventional mobile robotic vacuum cleaner, comprising an inlet 31 at the bottom side thereof, an outlet 33 at the top side thereof, a detachable cover plate 32 covering the outlet 33, a non-turn member 34 mounted in the inlet 31, a wire gauze filter 35 mounted in the outlet 33, a locating post 37 vertically downwardly extended from the downward-facing plane 36 of the downward-opening and forward-opening bottom recess thereof, and a springy retainer 38 located on the rear side thereof.

The chips collection box 40 comprises, in integrity, a bottom panel 41, a front panel 42, a back panel 43, a left panel 44 and a right panel 45, a detachable top panel 46, a front fillet surface 421 defined between the front panel 42 and the bottom panel 41, a protruding block 47 disposed at the top side of the front fillet surface 421, a rear fillet surface 431 defined between the back panel 43 and the bottom panel 41, a positioning sleeve 432 formed integral with the outside wall of the back panel 43, two openings 48 respectively defined between the left panel 44 and right panel 45 and the detachable top panel 46, and two arched guide faces 49 respectively formed on the left panel 44 and the right panel 45 between the openings 48 and the bottom panel 41.

As illustrated in FIG. 5, the chips collection box 40 is connected to the dust collection box 30 by attaching the positioning sleeve 432 onto the locating post 37. Further, an elastic member, for example, compression spring 50 is sleeved onto the locating post 37 and stopped with its two opposite ends against the dust collection box 30 and the positioning sleeve 432. Further, a fastening member 52 is fastened to the bottom side of the dust collection box 30 to prevent escape of the positioning sleeve 432 and the compression spring 50 from the locating post 37. Thus, the positioning sleeve 432 can be moved linearly along the locating post 37 to compress or release the compression spring 50, and therefore the chips collection box 40 and the dust collection box 30 can be moved linearly up and down relative to each other.

When mounting the dust collector 20 in the dust collector mounting trough 12 of the mobile robotic vacuum cleaner 10, the front protruding block 47 of the chips collection box 40 is movable up and down with the chips collection box 40 in a limiter groove 18 in the front side of the dust collector mounting trough 12, and the springy retainer 38 at the rear side of the dust collection box 30 is secured to the top side of the dust collector mounting trough 12. At this time, the outlet 33 and wire gauze filter 35 of the dust collection box 30 are disposed adjacent to and right below the electric fan 14 and the two openings 48 of the chips collection box 40 are respectively disposed adjacent to the roller brushes 17.

During operation of the mobile robotic vacuum cleaner 10, the electric fan 14 induces currents of air flowing from the outside open air through the inlet 31 of the dust collection box 30 into the inside of the dust collection box 30 and then through the outlet 33 toward the outside of the mobile robotic vacuum cleaner 10 via exhaust holes 19 of the mobile robotic vacuum cleaner 10. During this process, dust carried in the currents of air is stopped by the wire gauze filter 35 and gathered in the inside of the dust collection box 30, and the non-return member 34 prohibits collected dust from falling out of the dust collection box 30 through the inlet 31.

Further, during operation of the mobile robotic vacuum cleaner 10, the two roller brushes 17 are continuously rotated to direct chips and solid particles from the floor into the inside of the chips collection box 40. Subject to the spring power of the compression spring 50, the chips collection box 40 is forced downwards to stop the bottom edges of the arched guide faces 49 against the floor, and therefore the two arched guide faces 49 work as a dustpan, enabling the two roller brushes 17 to direct chips and solid particles from the floor along the two arched guide faces 49 through the two openings 48 into the inside of the chips collection box 40. Further, when the mobile robotic vacuum cleaner 10 encounters an obstacle during its forward movement, the front fillet surface 421 of the chips collection box 40 will be forced by the obstacle, causing the chips collection box 40 to be lifted. In the same way, the rear fillet surface 431 of the chips collection box 40 can prevent the chips collection box 40 from being stuck in an obstacle during a backward movement of the mobile robotic vacuum cleaner 10.

By means of the functioning of the dust collector 20, dust, solid particles and chips sucked by the mobile robotic vacuum cleaner 10 will be gathered in the dust collection box 30 and the chips collection box 40. Thus, even non-dust articles are directed into the inside of the chips collection box 40, the user can discover the non-dust articles when cleaning the chips collection box 40 and the collected non-dust articles can be cleaned easily.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A dust collector used in a mobile robotic vacuum cleaner, comprising:

a dust collection box; and a chips collection box connected to said dust collection box, said chips collection box comprising at least one opening disposed adjacent to one respective roller brush of said mobile robotic vacuum cleaner and adapted for receiving chips directed by said roller brush for enabling said chips to be gathered in said chips collection box, wherein said chips collection box is vertically and linearly movably connected to said dust collection box, and an elastic member is connected between said chips collection box and said dust collection box.

2. The dust collector as claimed in claim 1, wherein said chips collection box comprises a front fillet surface located on a front side of a bottom wall thereof and a rear fillet surface located on a rear side of said bottom wall opposite to said front fillet surface.

3. The dust collector as claimed in claim 1, wherein said chips collection box comprises at least one guide face downwardly extending from said at least one opening.

4. The dust collector as claimed in claim 3, wherein each said guide face of said chips collection box is arch-shaped.

5. The dust collector as claimed in claim 1, wherein said chips collection box comprises a bottom panel, a front panel, a back panel disposed at a front side of said dust collection box, a front fillet surface defined between said front panel and said bottom panel, a rear fillet surface defined between said back panel and said bottom panel, two openings respectively disposed at left and right sides of said chips collection box, and two arched guide faces respectively disposed between said two openings and said bottom panel.

6. The dust collector as claimed in claim 5, wherein said dust collection box comprises a downward-facing plane located on an outer wall thereof and a locating post downwardly extended from said downward-facing plane; said chips collection box comprises a positioning sleeve located on an outside wall of said back panel and sleeved onto said locating post; said elastic member is mounted around said locating post and stopped between said dust collection box and said sleeve.

* * * * *